US007845845B1

(12) United States Patent
Kelly

(10) Patent No.: US 7,845,845 B1
(45) Date of Patent: Dec. 7, 2010

(54) VESSEL WITH SECURING DEVICE

(76) Inventor: Dwight E. Kelly, 91 Husted Station Rd., Elmer, NJ (US) 08318

( * ) Notice: Subject to any disclaimer, the term of this patent is extended or adjusted under 35 U.S.C. 154(b) by 240 days.

(21) Appl. No.: 11/175,713

(22) Filed: Jul. 6, 2005

(51) Int. Cl.
*B01F 13/08* (2006.01)

(52) U.S. Cl. ..... 366/274; 422/102; 220/606; 215/373; 215/376

(58) Field of Classification Search ..... 366/197, 366/200, 209–217, 274; 206/509, 511; 422/102; 220/23.83, 606; 215/10, 373, 376; 108/26; 211/74
See application file for complete search history.

(56) References Cited

U.S. PATENT DOCUMENTS

| | | | | | |
|---|---|---|---|---|---|
| 899,811 | A * | 9/1908 | Stewart | 220/23.83 |
| 1,429,652 | A * | 9/1922 | Small | 366/214 |
| 1,626,930 | A * | 5/1927 | Grogg | 206/508 |
| 1,663,822 | A * | 3/1928 | Walker | 215/376 |
| 1,876,264 | A * | 9/1932 | Tucker | 108/25 |
| 2,641,374 | A * | 6/1953 | Der Yuen | 215/10 |
| 2,656,163 | A * | 10/1953 | Schwarz | 220/606 |
| 3,250,422 | A * | 5/1966 | Parish | 220/23.83 |
| 3,318,583 | A * | 5/1967 | Wright | 366/197 |
| 4,212,546 | A * | 7/1980 | Porteous | 366/213 |
| 4,577,975 | A * | 3/1986 | McCrory et al. | 366/314 |
| 4,978,023 | A * | 12/1990 | Behlmann et al. | 220/23.6 |
| 5,676,251 | A * | 10/1997 | Credle, Jr. | 206/501 |
| 2002/0172091 | A1 * | 11/2002 | Hatakeyama | 366/144 |

* cited by examiner

*Primary Examiner*—David L Sorkin
(74) *Attorney, Agent, or Firm*—John F. A. Earley, III; Frank J. Bonini, Jr.; Harding, Earley, Follmer & Frailey, P.C.

(57) ABSTRACT

A vessel with an engaging configuration for facilitating supporting the vessel on a supporting structure, such as for example, a surface, tray, agitator, stirrer, or other processing device, which has a corresponding matingly engagable structure for engaging with the vessel engaging configuration.

8 Claims, 2 Drawing Sheets

VESSEL WITH SECURING DEVICE

BACKGROUND OF THE INVENTION

1. Field of Invention

The invention relates to the field of vessels and containers, and in particular, a device for holding a vessel.

2. Brief Description of the Related Art

A variety of vessels are used for holding and containing liquids. Generally, vessels are used in laboratories, including research and development laboratories, hospitals and industries, for holding and containing liquids. Vessels may serve, for example, as a containment for a reaction of components, or a liquid storage device. Commonly used are vessels for containing reagents. The vessels may, for example, be provided in the form of a flask, beaker, or specifically configured shape to accommodate the reagents, byproducts, or conditions at which a reaction is to take place.

Often, it is necessary to agitate or stir the contents of a vessel. One stirring device uses a motor-driven magnet to drive another magnet which is placed inside the vessel. Other vessels are fitted with an agitation or stirring element which may be directly positioned within the vessel space and sealed from the exterior of the vessel. It is generally the case where a plurality of vessels are used at once. A vessel may be placed on a tray or plate for agitation. For example, magnetic stirrers are often used, wherein a vessel is placed on a plate, and a magnetic stirring element placed in the vessel. The plate may be part of a stirring device with a housing, a motor and a magnet provided to move the stirrer.

In many laboratories today, mixing in vessels is done on a flask tray with an orbital shaker. To hold the vessel in place on the flask tray, flask clamps are used. Unfortunately, flask clamps in the market today are very expensive. Moreover, more than one size clamp is usually needed since different size clamps are needed to fit different size vessels. A need exists for an improved vessel which may be stabilized when placed on a surface, such as, for example, a stirrer, agitator or surface of another device used for carrying out laboratory or analytical procedures, without the need of flask or vessel clamps.

SUMMARY OF THE INVENTION

The invention provides a vessel with an engaging configuration for engaging a mating configuration provided on a mating surface, such as, for example, a tray. The vessel has use in a particularly preferred embodiment having a mating configuration to facilitate attachment to a plate having corresponding matingly engagable structure. The plate may be part of a device useful for processing the vessel, such as, for example, a stirring or agitating device.

In one embodiment, the vessel is configured to receive mating inserts or projections of a supporting surface, such as, a plate. In another embodiment, the vessel may have a bottom surface with ramped grooves for receiving a plurality of matingly associated pins of a supporting surface. Another embodiment provides a vessel having an inner cavity which is adapted to receive an insert of a plate or other surface.

BRIEF DESCRIPTION OF THE DRAWING FIGURES

Figure 5:
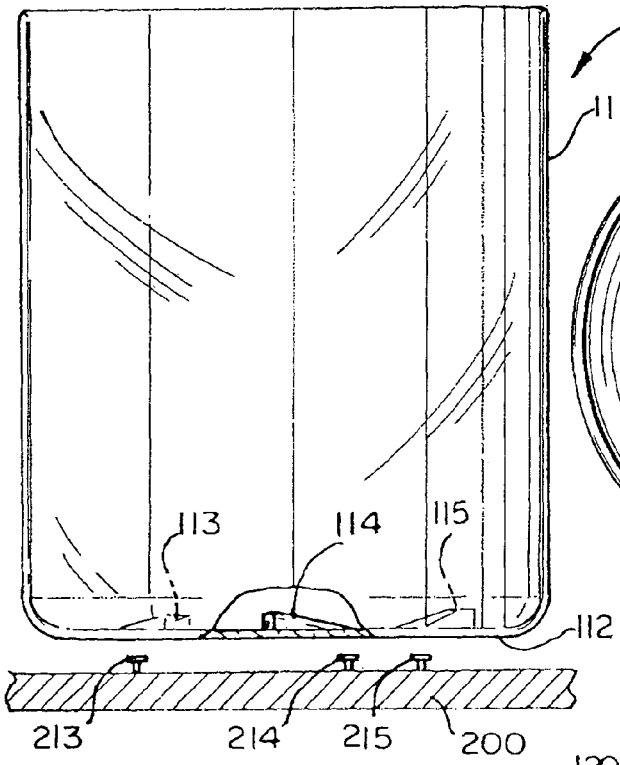

FIG. 5 is a view of a second embodiment of a vessel according to the present invention, with the vessel 100 being shown in side elevation and having a partial cut away view to illustrate the bottom wall of the vessel 100 and with the supporting surface 200 being shown in cross section.

Figure 6:
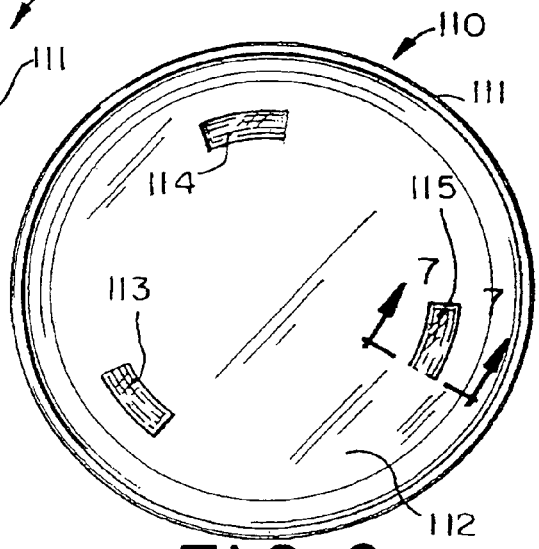

FIG. 6 is a top plan view of the bottom wall of the vessel of FIG. 5.

Figure 7:
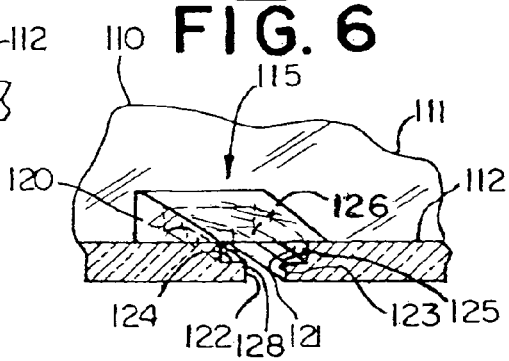

FIG. 7 is a view in section taken along the lines and arrows 7-7 of FIG. 6 illustrating the ramped groove of the second embodiment of the invention.

Figure 8:
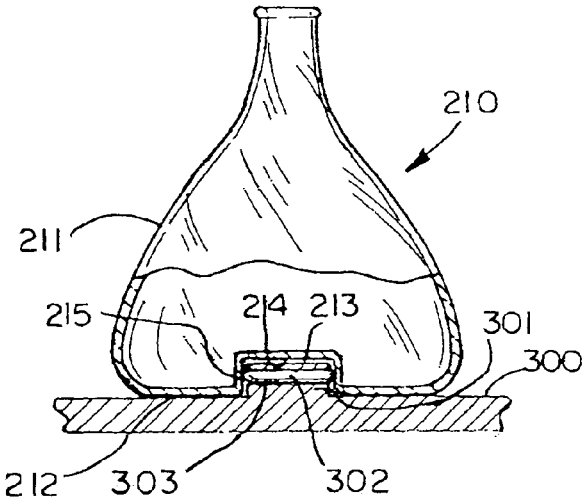

FIG. 8 is a sectional view of a third embodiment of a vessel according to the present invention.

Figure 9:
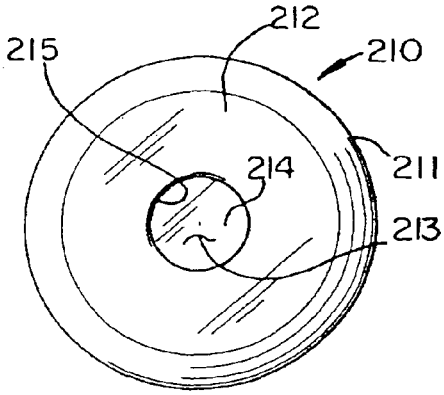

FIG. 9 is a bottom plan view of the floor of the vessel of FIG. 8, as viewed looking from the bottom of the vessel.

DETAILED DESCRIPTION OF THE PREFERRED EMBODIMENTS

Figure 1:
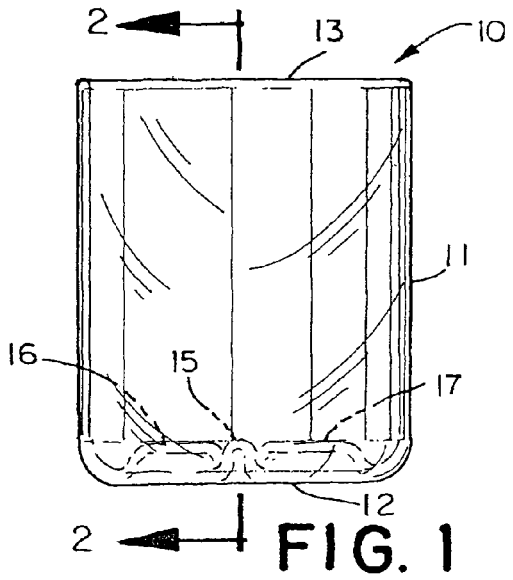
FIG. 1 is a side elevational view of a first embodiment of a vessel according to the present invention.
Figure 2:
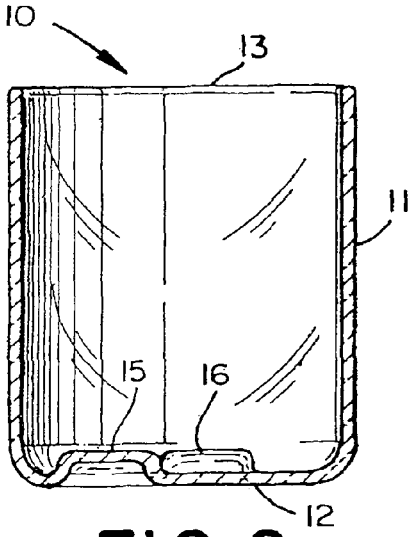
FIG. 2 is a sectional view of the vessel of FIG. 1, taken longitudinally to illustrate the grooves in the vessel floor.
Figure 3:
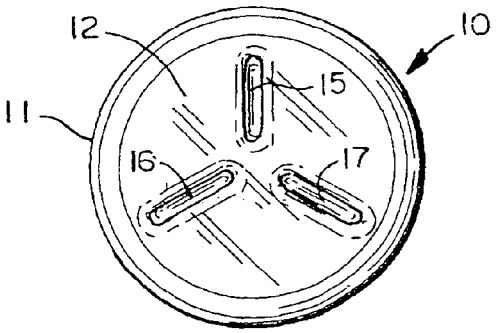
FIG. 3 is a plan view of the floor of the vessel of FIGS. 1 and 2, as viewed looking from the bottom of the vessel.
Figure 4:
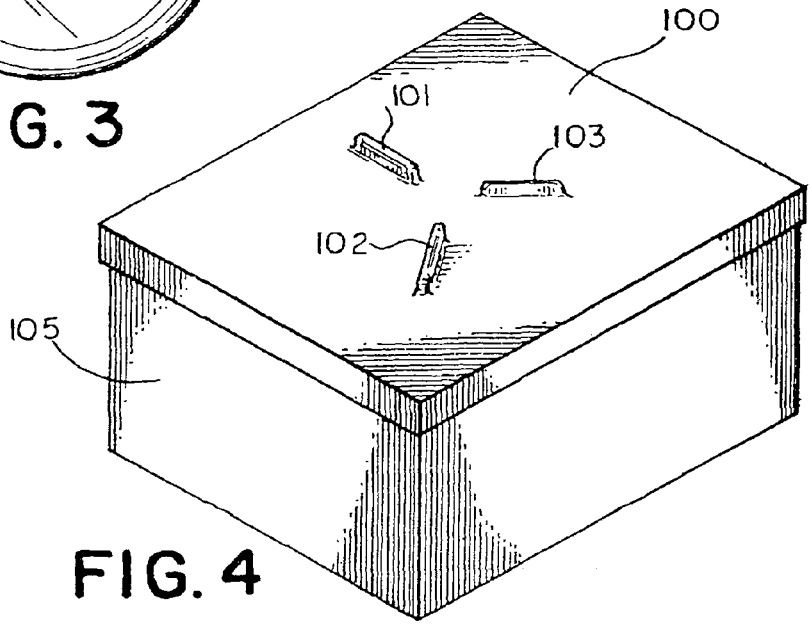
FIG. 4 is a perspective view, looking from the top left, of a supporting surface showing mating projections, and being supported on a base which may comprise an analytical device, such as, for example, a magnetic stirrer.

Referring to FIGS. 1-3, a vessel 10 is shown having securing means for securing the vessel to a supporting structure or surface 100 (FIG. 4). The vessel 10 has at least one wall 11 and a bottom wall or floor 12 for containing a substance therein. Optionally, though not shown, a cover may be provided to cover the opening 13 of the vessel 10. For example, the vessel 10 preferably may be used to contain solid matter, liquid matter, or mixtures thereof.

The vessel 10 is illustrated with securing means preferably comprising a plurality of tapered indents 15, 16, 17. The tapered indents 15, 16, 17 preferably are matingly configured to correspond with the supporting surface 100, in particular, the projections 101, 102, 103 provided on the supporting surface 100, as shown in FIG. 4. The indents 15, 16, and 17, and the corresponding projections 101, 102, 103 of the supporting surface 100, may optionally be provided to have a particular configuration, in the event orientation of the vessel 10 on a surface 100 is desired. For example, if a particular orientation is desired, the indents 15, 16, and 17 may be provided or formed asymmetrically, so that only one matingly fitting orientation is possible when placing the vessel 10 on a supporting surface which is likewise configured.

Turning to FIG. 4, a supporting surface 100 is illustrated, for example, as a plate supported on a base 105. The base 105, illustrated as a box, may represent a stirrer, agitator, or other device used for carrying out processes on vessels or the contents of a vessel. The vessel 10 may be formed from glass, plastic, or other suitable material.

In use, vessel 10 may be placed on surface 100 such that projections 101, 102, 103 provided on the surface 100 are positioned in the corresponding indents 15, 16, and 17 of the vessel 10 to hold the vessel 10 securely in place on the surface 100. With the vessel 10 held securely in place on the surface 100, the base 105, which may be a stirrer, an agitator, or other device, may be activated for carrying out processes (e.g., stirring, agitating, etc.) on the vessel 10 or the contents of the vessel 10. When the process has been carried out, the vessel 10 may be removed from the surface 100 by lifting the vessel upwardly from the surface 100.

FIGS. 5 and 6 illustrate a second preferred embodiment of the invention, showing a vessel 110 having a side wall 111 and a bottom wall or floor 112 and securing means. The securing means are shown comprising a plurality of ramped grooves 113, 114, 115. A supporting surface 200 is shown having a plurality of matingly associated securing elements, preferably nail head style pins 213, 214, 215. Although not shown, the supporting surface 200 may be provided in the form of a tray, agitation or stirrer device, or other suitable processing device. The ramped grooves 113, 114, 115 preferably are arcuately configured to facilitate mounting of the vessel 110 such that by positioning the pins 213, 214, 215 in the entrance openings to the grooves 113, 114; 115, and then rotating the vessel 110 relative to the surface 200, the pins 213, 214, 215 are secured in the grooves 113, 114, 115. Preferably, the ramped configuration provides for increasingly securing the pins 213, 214, 215 with the grooves 113, 114, 115.

FIG. 7 shows an enlarged view of a portion of the bottom wall 112 of the vessel 110 to illustrate a preferred configuration for the ramped grooves, ramped groove 115 being used in FIG. 7 to illustrate this. The ramped groove 115 has a first side wall 120, and a second side wall 121 which face each other. Each side wall 120, 121 has a ramped ledge or flange 122, 123, respectively. The first ramped flange 122 has a facing surface 128 and a camming surface 124, and similarly, the second ramped flange 123 has a facing surface 125 and a camming surface 126. The grooves 113 and 114 may be configured in the same manner as the groove 115 shown and described herein.

The vessel 110 may be formed from glass, plastic or other suitable materials.

In use, vessel 110 may be secured to surface 200 by positioning the vessel 110 over surface 200 such that the pins 213, 214, and 215 are received by the openings for the corresponding ramped grooves 113, 114, and 115, and then twisting or rotating the vessel 110 to cause the nail head style end portion of the pins 213, 214, and 215 to ride up the ramped grooves 113, 114, 115 such that the nail head style end portion of the pins 213, 214, 215 is positioned above the ledges 122 and 123 in the corresponding ramped grooves 113, 114, and 115, with the stem of the pins 213, 214, and 215 extending through the gap between the ledges 122 and 123 of the corresponding ramped grooves 113, 114, and 115.

Since the nail head style end portion of the pins 213, 214, and 215 is wider than the gap between the ledges 122 and 123 of each ramped groove 113, 114, and 115, the vessel 110 is prevented from being removed from the surface 200, unless the vessel 110 is rotated in a direction opposite that used to secure the vessel 110 to the surface 200 so that the nail head style end portion of the pins 213, 214, and 215 are again located at the openings to the grooves 113, 114, and 115.

With the vessel 110 held securely in place on the surface 200, a base 105, which may be a stirred, an agitator, or other device, and to which surface 200 is connected, may be activated for carrying out processes (e.g., stirring, agitating, etc.) on the vessel 110 or the contents of the vessel 110. When the process has been carried out, the vessel 110 may be removed from the surface 200 by rotating the vessel 110 to position the nail head style end portion of the pins 213, 214, and 215 at the openings to the grooves 113, 114, and 115 and the lifting the vessel 110 from the surface 200.

FIGS. 8 and 9 illustrate a third preferred embodiment of the inventor, showing a vessel 210 constructed in accordance with the invention. The vessel 210 has a side wall 211, a bottom wall or floor 212, and a cavity 213 found in the exterior of the floor 212. The cavity 213 is configured for mating engagement with a supporting element, such as for example, the insert 301 of a supporting surface 300, which for example, may be a plate, tray or other surface on which the vessel 210 is to be placed.

The cavity 213 preferably has a cavity surface portion 214 which is provided at a predetermined distance from the floor 212 of the vessel 210. A wall 215 is provided connecting the portion of the floor 212 of the vessel 210 that is outside the cavity 213 with the cavity surface portion 214. Preferably, as illustrated, the wall 215 is provided having a cylindrical configuration. The supporting surface 300 has an insert 301, which preferably is configured to correspond with the configuration of the cavity 213 of the vessel 210. As illustrated, the insert 301 is cylindrical. Preferably, retaining means is provided to facilitate the engagement of the insert 301 with the vessel 210. The retaining means is illustrated by an o-ring 303, which preferably is an elastic, replaceable o-ring. The insert 301 has an annular groove 302 in which the o-ring 303 is seated. The o-ring 303 engages with the wall 215 of the vessel 210 to facilitate securing of the vessel 210 on the supporting structure 300.

The vessel 210 may be formed from glass, plastic, or the other suitable material.

In use, vessel 210 may be placed on the surface 300 such that insert 301 is received by captivity 213, with the o-ring preferably engaging the wall 215 of the vessel 210, to hold vessel 210 securely in place on the surface 300. With the vessel 210 held securely in place on the surface 300, the base 105, which may be a stirred, an agitator, or other device, and to which surface 300 is connected, may be activated for carrying out processes (e.g., stirring, agitating, etc.) on the vessel 210 or the contents of the vessel 210. When the process has been carried out, the vessel 210 may be removed from the surface 300 by pulling the vessel 210 off the insert 301.

The vessels described herein may comprise a beaker, flask, or other containment structure useful for mixing or storing reagents, chemicals or fluids. While configurations of a beaker and flask are shown, other forms and shapes of vessels may be used in connection with the invention as disclosed and described herein.

As discussed herein in connection with the first supporting structure 100, the supporting structures 200 and 300 may comprise part of a device, such as, for example, an agitator, stirrer, or other processing device. In addition, the supporting structure may contain multiple securing means so that one or a plurality of vessels may be held thereon. An example is where the supporting structure comprises a tray having a plurality of securing means for holding a number of vessels at the same time. This facilitates operations where several runs/analyses are being carried out simultaneously or contemporaneously, and a plurality of vessels are to be used. In this manner, the vessels may be secured on a single supporting surface, and therefore, may undergo similar agitation, stirring, or other processes.

While the invention has been described with reference to specific embodiments, the description is illustrative and is not to be construed as limiting the scope of the invention. Various modifications and changes may occur to those skilled in the art without departing from the spirit and scope of the invention described.

What is claimed is:

1. A vessel in combination with a supporting structure of a device used for holding the vessel and manipulating the vessel contents, the vessel having securing means for securing the vessel to the supporting structure, the vessel comprising:

a) at least one wall forming a space therein for receiving and containing a substance; and b) securing means for securing the vessel to a supporting surface of said device used for holding the vessel and manipulating the vessel contents;

c) a floor;

d) wherein the securing means are provided integrally with the vessel and on the floor of said vessel, e) wherein said floor is integrally provided with said at least one wall;

f) wherein the securing means comprises a cavity;

g) wherein said supporting structure is connectable with and detachable from said vessel; and h) wherein the cavity is formed in the floor of the vessel and is defined in part by a cylindrical side wall, wherein the supporting structure has an insert configured to correspond with the cavity, and wherein the correspondingly configured insert has a cylindrical configuration and an annular groove formed around the insert and an o-ring disposed in said annular groove to contact both the vessel and the insert when the cavity is placed onto the insert, wherein said o-ring is situated within the cavity when said supporting structure insert is positioned within said cavity.

2. The apparatus of claim 1, wherein said supporting structure comprises a tray.

3. The apparatus of claim 1, wherein said supporting structure comprises an agitator.

4. The apparatus of claim 1, wherein said supporting structure comprises a stirrer.

5. The apparatus of claim 1, wherein said supporting structure comprises a processing device.

6. The apparatus of claim 1, wherein the vessel comprises a beaker.

7. The apparatus of claim 6, wherein the beaker is comprised of glass.

8. The apparatus of claim 1, wherein the vessel comprises a flask.

* * * * *